US011374344B2

(12) United States Patent
Yao et al.

(10) Patent No.: US 11,374,344 B2
(45) Date of Patent: Jun. 28, 2022

(54) PROTECTING COVER ADAPTED FOR A CONNECTING PORT AND CONNECTING PORT DEVICE THEREWITH

(71) Applicant: Moxa Inc., New Taipei (TW)

(72) Inventors: Min-Heng Yao, New Taipei (TW); Chun-Jen Shih, New Taipei (TW)

(73) Assignee: Moxa Inc., New Taipei (TW)

( * ) Notice: Subject to any disclaimer, the term of this patent is extended or adjusted under 35 U.S.C. 154(b) by 0 days.

(21) Appl. No.: 17/223,030

(22) Filed: Apr. 6, 2021

(65) Prior Publication Data

US 2022/0149557 A1 May 12, 2022

(30) Foreign Application Priority Data

Nov. 11, 2020 (TW) ..... 109139325

(51) Int. Cl.
*H01R 13/453* (2006.01)
*H01R 13/52* (2006.01)

(52) U.S. Cl.
CPC ..... *H01R 13/4536* (2013.01); *H01R 13/5213* (2013.01)

(58) Field of Classification Search
CPC ..... H01R 13/4536; H01R 13/5213; H01R 33/97; H01R 13/6397; H01R 13/443; H01R 24/64
See application file for complete search history.

(56) References Cited

U.S. PATENT DOCUMENTS 8,512,061 B2 8/2013 Morrison
8,672,694 B2 3/2014 Lee
8,845,355 B2 * 9/2014 Litowitz ..... H01R 13/5213 439/357
9,735,507 B1 8/2017 Liang
9,843,134 B1 * 12/2017 Mosholder ..... H05K 1/0275
10,624,222 B2 * 4/2020 Ahn ..... H05K 5/0208
10,637,189 B1 * 4/2020 Ahn ..... H01R 13/627
2012/0282788 A1 * 11/2012 Lin ..... H01R 43/26 439/135
2013/0102167 A1 * 4/2013 Litowitz ..... H01R 13/5213 439/135

FOREIGN PATENT DOCUMENTS

CN 210182654 U 3/2020
TW I429141 B 3/2014

* cited by examiner

*Primary Examiner* — Tho D Ta
(74) *Attorney, Agent, or Firm* — Winston Hsu

(57) ABSTRACT

A protecting cover includes a latching component and a releasing component. The latching component includes an engaging portion. The engaging portion engages with a cooperating portion of a connecting port when the latching component is at least partially accommodated inside the connecting port. The releasing component is detachably installed on the latching component and includes a resilient arm. The resilient arm abuts against the engaging portion to drive the engaging portion to disengage from the cooperating portion by operation of the resilient arm when the releasing component is installed on the latching component. The latching component at least partially accommodated inside the connecting port covers a front opening of the connecting port, and removal of the latching component requires the releasing component. It not only prevents outside dust particles or substances from entering into the connecting port but also prevents an unauthorized connection of the connecting port.

20 Claims, 13 Drawing Sheets

PROTECTING COVER ADAPTED FOR A CONNECTING PORT AND CONNECTING PORT DEVICE THEREWITH

BACKGROUND OF THE INVENTION

1. Field of the Invention

The present invention relates to a protecting cover adapted for a connecting port and a connecting port device therewith, and more particularly, to a protecting cover which can prevent outside dust particles or substances from entering into a connecting port but also prevent an unauthorized connection of the connecting port, and a connecting port device therewith.

2. Description of the Prior Art

With advancement of technology, communication network technology is widely used indifferent various industrial automation systems for allowing data transmission between apparatuses, so as to achieve equipment automation control and management. In order to achieve connection between apparatuses through a communication network, the apparatus is usually provided with a network connecting port for connecting with a network cable. An interface between the network connecting port and the network cable can conform to, for example, RJ45 interface. The network connecting port usually adopts an open design, which not only causes a poor contact of the network connecting port due to intrusion of outside dust particles or substances, but also has a security risk posed by an unauthorized connection of the network connecting port.

SUMMARY OF THE INVENTION

Therefore, it is an objective of the present invention to provide a protecting cover which can prevent outside dust particles or substances from entering into a connecting port but also prevent an unauthorized connection of the connecting port, and a connecting port device therewith.

In order to achieve the aforementioned objective, the present invention discloses a protecting cover adapted for a connecting port. The protecting cover includes a latching component and a releasing component. The latching component is at least partially accommodated inside the connecting port. The latching component includes an engaging portion. The engaging portion engages with a cooperating portion of the connecting port when the latching component is at least partially accommodated inside the connecting port. The releasing component is detachably installed on the latching component. The releasing component includes a resilient arm. When the releasing component is installed on the latching component, the resilient arm abuts against the engaging portion, so that the engaging portion is driven by operation of the resilient arm to disengage from the cooperating portion.

According to an embodiment of the present invention, the engaging portion does not protrude out of a front opening of the connecting port when the latching component is at least partially accommodated inside the connecting port.

According to an embodiment of the present invention, the resilient arm includes an abutting portion and an operating portion connected to the abutting portion. The abutting portion abuts against the engaging portion when the releasing component is installed on the latching component. The operating portion is exposed out of the front opening of the connecting port when the releasing component is installed on the latching component, and the operating portion drives the abutting portion to disengage the engaging portion from the cooperating portion when the operating portion is operated.

According to an embodiment of the present invention, the abutting portion is an inserting pin. An inserting hole is formed on the engaging portion, and the abutting portion is inserted into the inserting hole when the releasing component is installed on the latching component.

According to an embodiment of the present invention, the releasing component further includes a first connecting portion. The latching component further includes a second connecting portion, and the first connecting portion engages with the second connecting portion for preventing separation of the releasing component and the latching component when the releasing component is installed on the latching component.

According to an embodiment of the present invention, a first engaging structure is formed on the resilient arm. A second engaging structure is formed on the engaging portion, and the first engaging structure engages with the second engaging structure for preventing separation of the resilient arm and the engaging portion when the resilient arm abuts against the engaging portion.

According to an embodiment of the present invention, the releasing component further includes a first connecting portion. The latching component further includes a second connecting portion, and the first connecting portion engages with the second connecting portion for preventing separation of the releasing component and the latching component when the releasing component is installed on the latching component.

According to an embodiment of the present invention, a first engaging structure is formed on the resilient arm. A second engaging structure is formed on the engaging portion, and the first engaging structure engages with the second engaging structure for preventing separation of the resilient arm and the engaging portion when the resilient arm abuts against the engaging portion.

According to an embodiment of the present invention, the releasing component further includes a first connecting portion. The latching component further includes a second connecting portion, and the first connecting portion engages with the second connecting portion for preventing separation of the releasing component and the latching component when the releasing component is installed on the latching component.

According to an embodiment of the present invention, a first engaging structure is formed on the resilient arm. A second engaging structure is formed on the engaging portion, and the first engaging structure engages with the second engaging structure for preventing separation of the resilient arm and the engaging portion when the resilient arm abuts against the engaging portion.

In order to achieve the aforementioned objective, the present invention further discloses a connecting port device. The connecting port device includes a connecting port and a protecting cover. The connecting port includes a cooperating portion. The protecting cover includes a latching component and a releasing component. The latching component is at least partially accommodated inside the connecting port. The latching component includes an engaging portion. The engaging portion engages with the cooperating portion when the latching component is at least partially accommodated inside the connecting port. The releasing component is detachably installed on the latching component. The releasing component includes a resilient arm. When the releasing component is installed on the latching component, the resilient arm abuts against the engaging portion, so that the engaging portion is driven by operation of the resilient arm to disengage from the cooperating portion.

According to an embodiment of the present invention, the engaging portion does not protrude out of a front opening of the connecting port when the latching component is at least partially accommodated inside the connecting port.

According to an embodiment of the present invention, the resilient arm includes an abutting portion and an operating portion connected to the abutting portion. The abutting portion abuts against the engaging portion when the releasing component is installed on the latching component. The operating portion is exposed out of the front opening of the connecting port when the releasing component is installed on the latching component, and the operating portion drives the abutting portion to disengage the engaging portion from the cooperating portion when the operating portion is operated.

According to an embodiment of the present invention, the abutting portion is an inserting pin. An inserting hole is formed on the engaging portion, and the abutting portion is inserted into the inserting hole when the releasing component is installed on the latching component.

According to an embodiment of the present invention, the releasing component further includes a first connecting portion. The latching component further includes a second connecting portion, and the first connecting portion engages with the second connecting portion for preventing separation of the releasing component and the latching component when the releasing component is installed on the latching component.

According to an embodiment of the present invention, a first engaging structure is formed on the resilient arm. A second engaging structure is formed on the engaging portion, and the first engaging structure engages with the second engaging structure for preventing separation of the resilient arm and the engaging portion when the resilient arm abuts against the engaging portion.

According to an embodiment of the present invention, the releasing component further includes a first connecting portion. The latching component further includes a second connecting portion, and the first connecting portion engages with the second connecting portion for preventing separation of the releasing component and the latching component when the releasing component is installed on the latching component.

According to an embodiment of the present invention, a first engaging structure is formed on the resilient arm. A second engaging structure is formed on the engaging portion, and the first engaging structure engages with the second engaging structure for preventing separation of the resilient arm and the engaging portion when the resilient arm abuts against the engaging portion.

According to an embodiment of the present invention, the releasing component further includes a first connecting portion. The latching component further includes a second connecting portion, and the first connecting portion engages with the second connecting portion for preventing separation of the releasing component and the latching component when the releasing component is installed on the latching component.

According to an embodiment of the present invention, a first engaging structure is formed on the resilient arm. A second engaging structure is formed on the engaging portion, and the first engaging structure engages with the second engaging structure for preventing separation of the resilient arm and the engaging portion when the resilient arm abuts against the engaging portion.

In summary, in the present invention, the latching component at partially accommodated inside the connecting port can effectively prevent outside dust particles or substances from entering into the connecting port. Furthermore, the engaging portion of the latching component only can be driven by the resilient arm to disengage from the cooperating portion of the connecting portion during operation of the resilient arm. Therefore, an unauthorized user cannot remove the latching component from the connecting port without the releasing component when the latching component is partially accommodated inside the connecting port and the releasing component is detached from the latching component. Therefore, the present invention can not only prevent the outside dust particles or substances from entering into the connecting port but also prevent an unauthorized connection of the connecting port.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, the term "couple" is intended to mean either an indirect or direct electrical/mechanical connection. Thus, if a first device is coupled to a second device, that connection may be through a direct electrical/mechanical connection, or through an indirect electrical/mechanical connection via other devices and connections.

Figure 1:
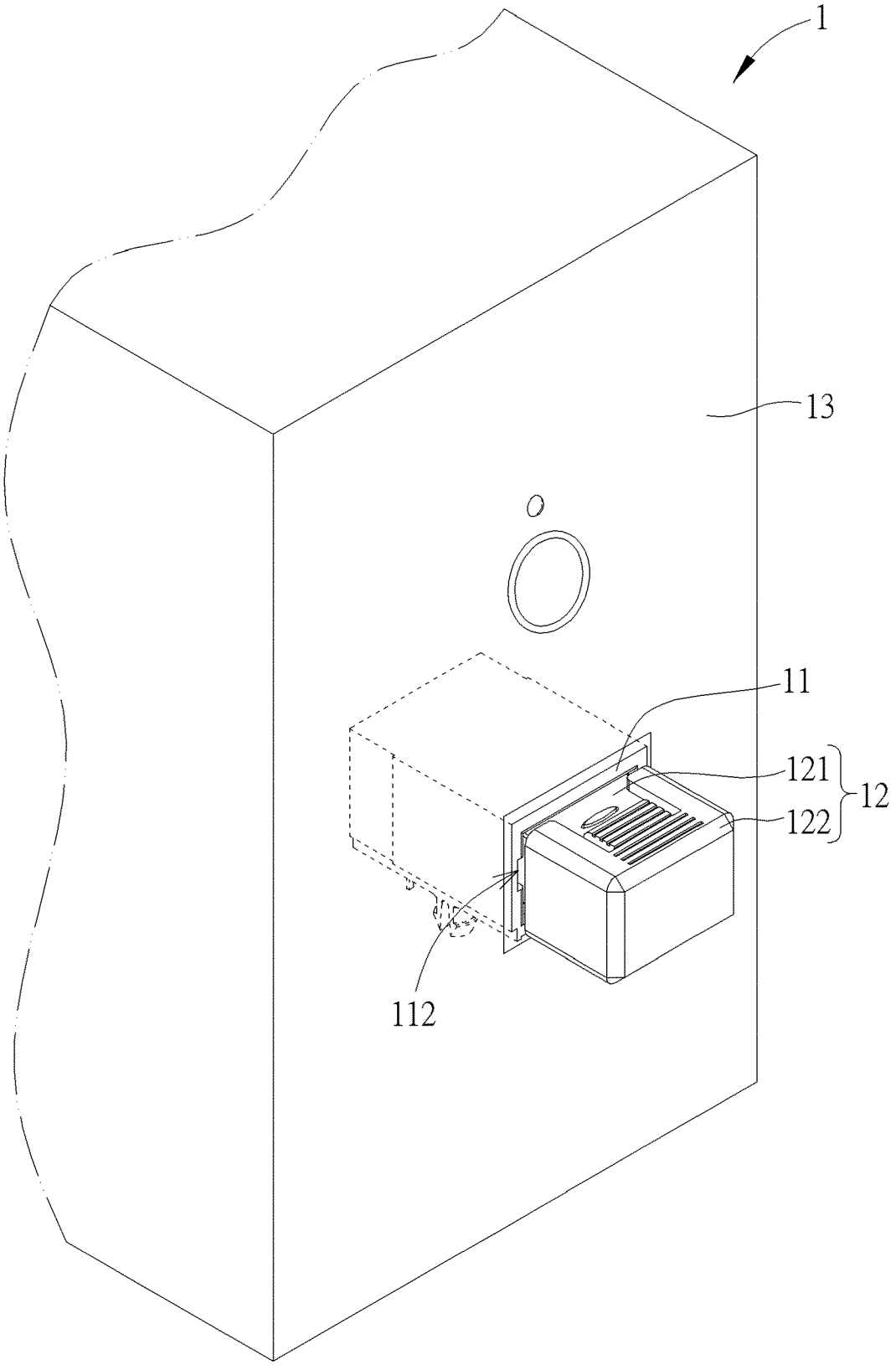
FIG. 1 and FIG. 2 are partial diagrams of a connecting port device in different in-used states according to a first embodiment of the present invention.
Figure 2:
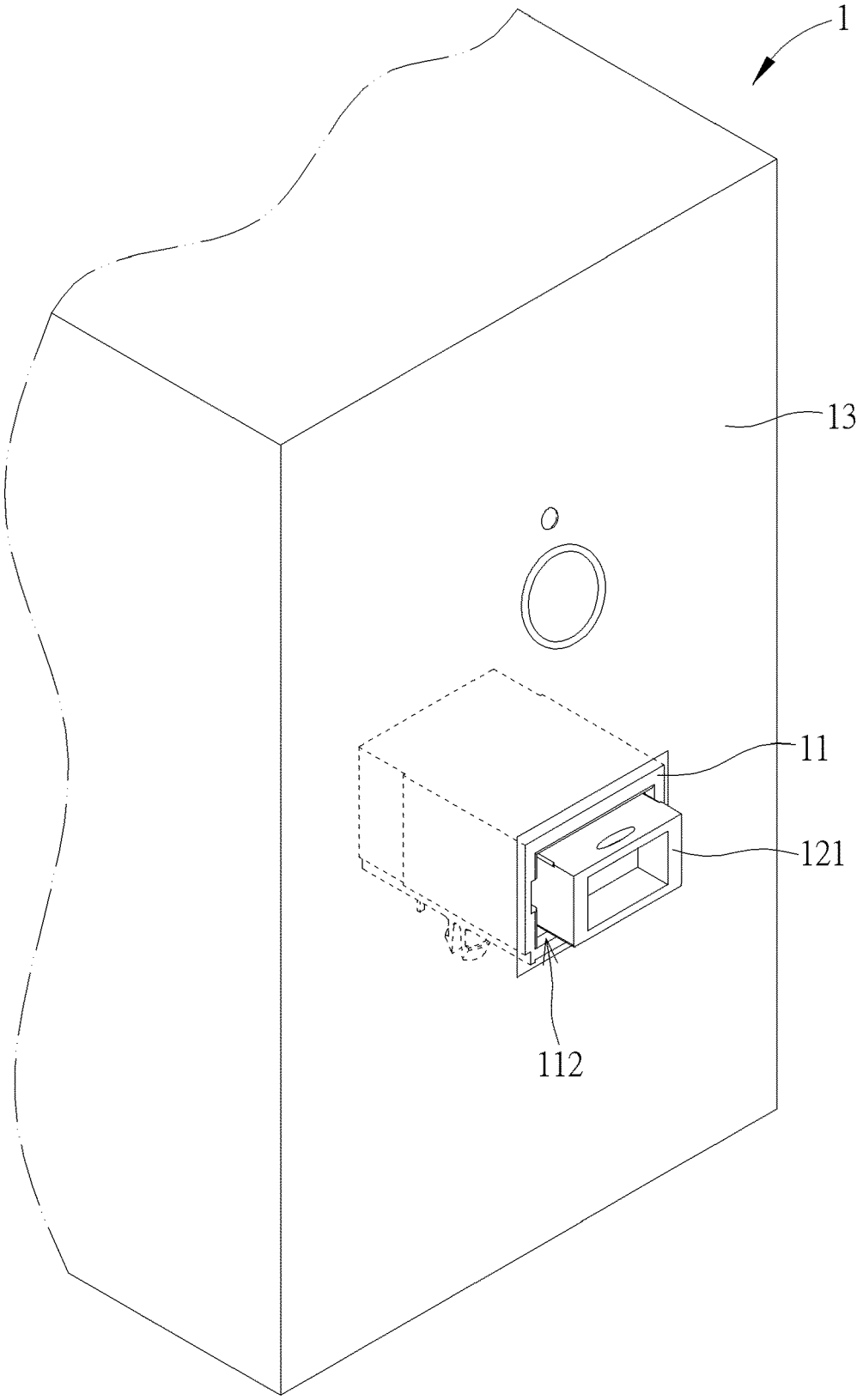
Figure 3:
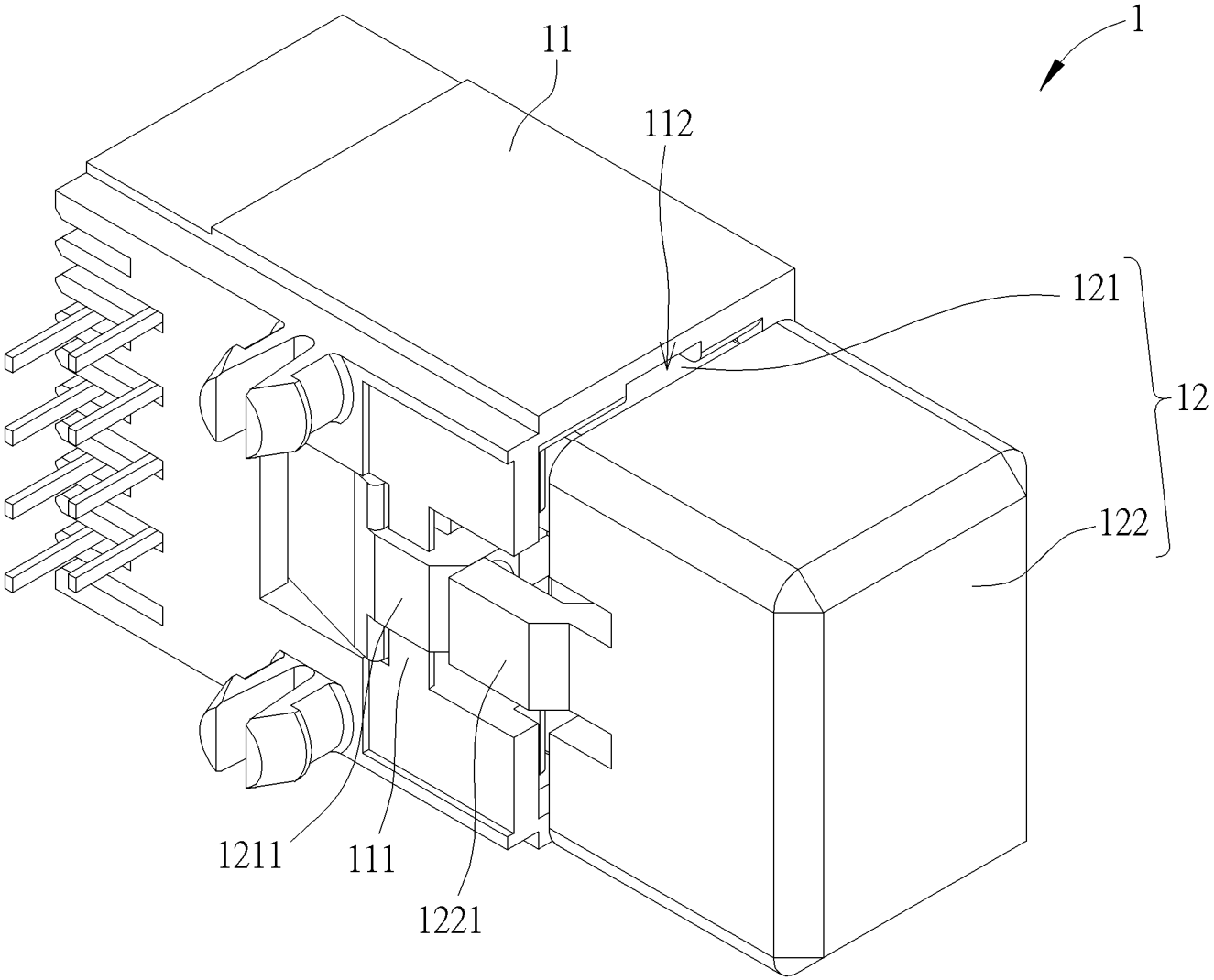
FIG. 3 is a partial diagram of the connecting port device at another view according to the first embodiment of the present invention.
Figure 4:
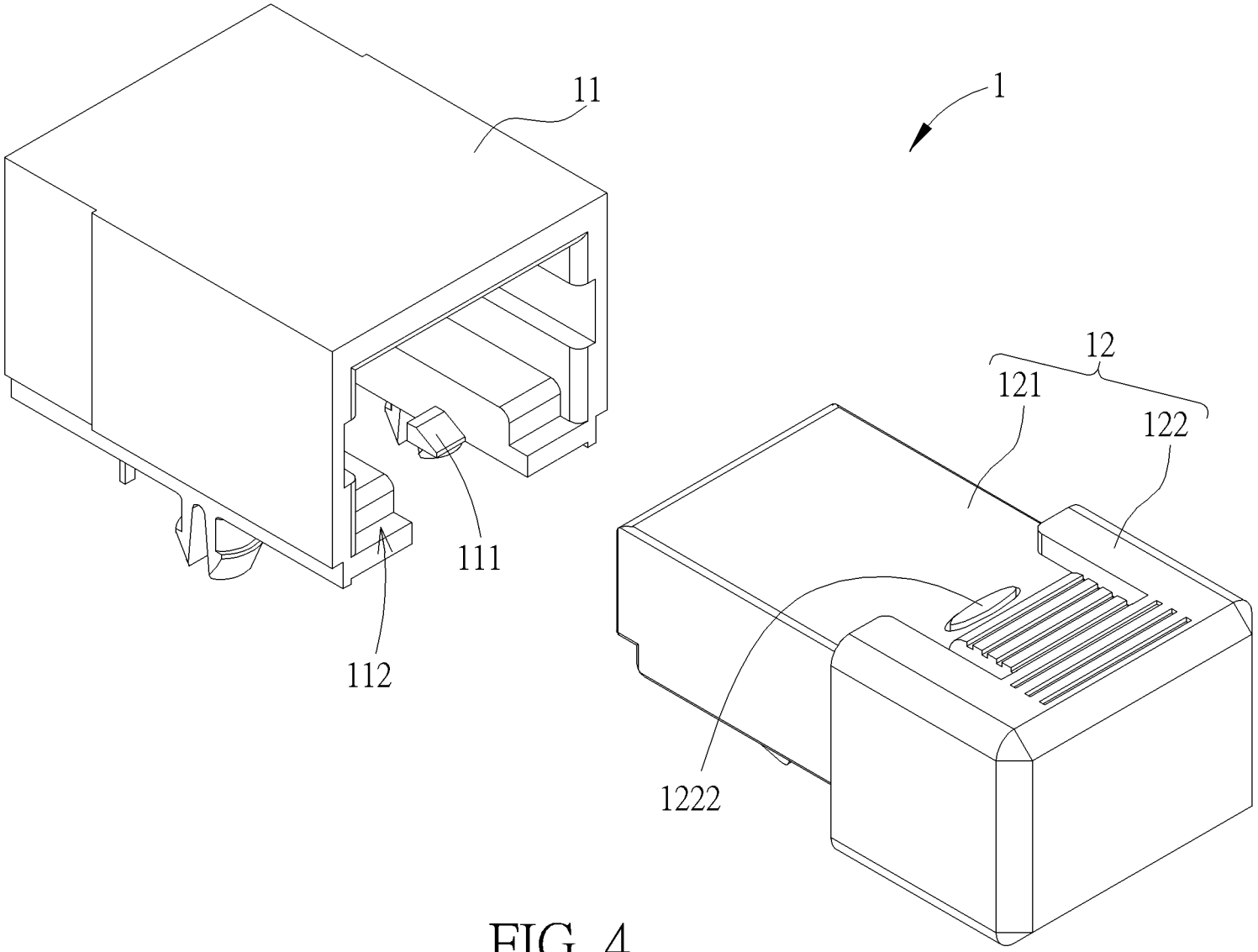
FIG. 4 and FIG. 5 are partial exploded diagrams of the connecting port device at different views according to the first embodiment of the present invention.
Figure 5:
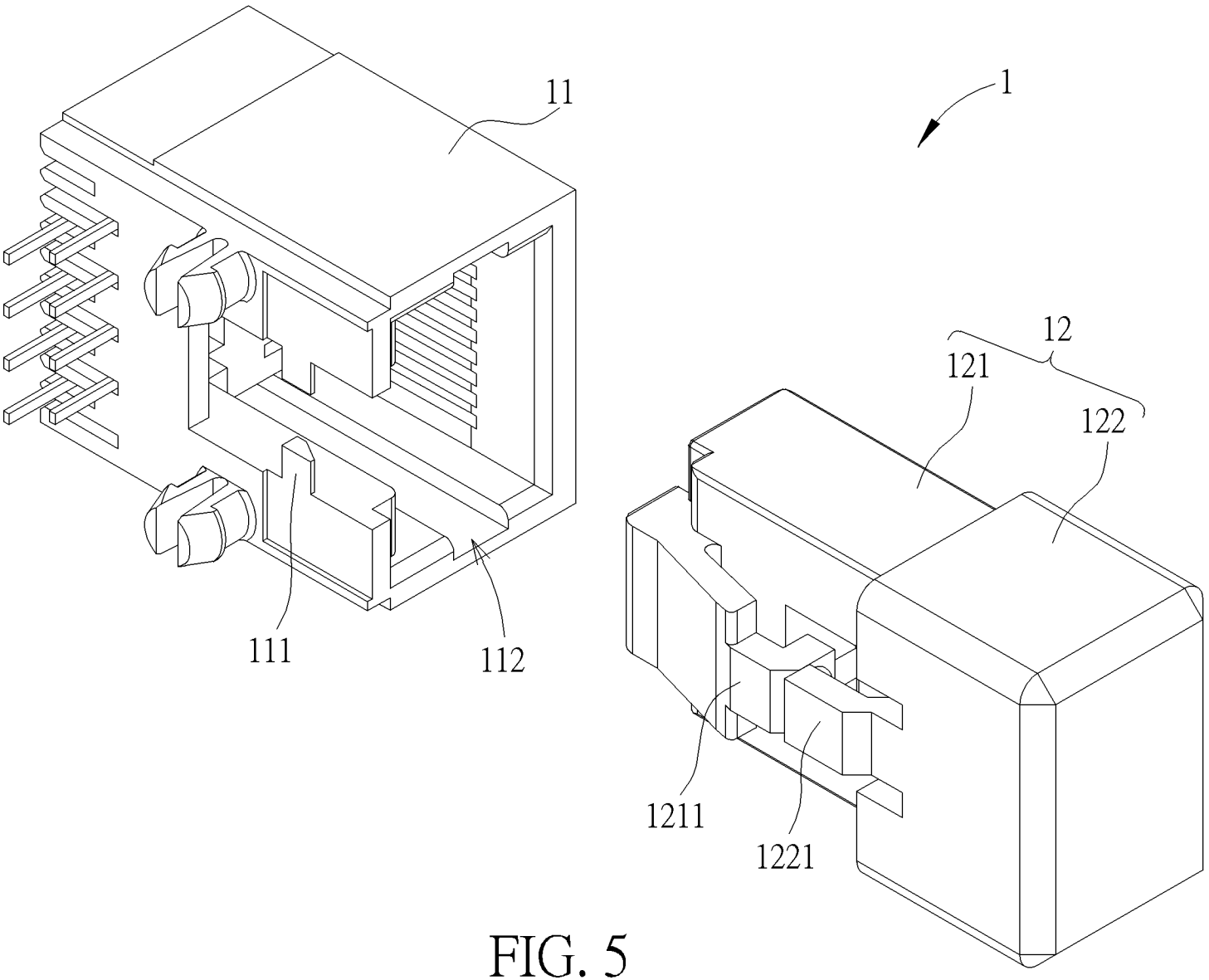

Please refer to FIG. 1 to FIG. 5. FIG. 1 and FIG. 2 are partial diagrams of a connecting port device 1 in different in-used states according to a first embodiment of the present invention. FIG. 3 is a partial diagram of the connecting port device 1 at another view according to the first embodiment of the present invention. FIG. 4 and FIG. 5 are partial exploded diagrams of the connecting port device 1 at different views according to the first embodiment of the present invention. As shown in FIG. 1 to FIG. 5, the connecting port device 1 includes a connecting port 11, a protecting cover 12 and a casing 13. The connecting port 11 is partially exposed out of the casing 13 and for connecting a connector of a cable, which is not shown in the figures. The connecting port 11 includes a cooperating portion 111 which is configured to engage with an engaging part of the connector of the cable for preventing an unintentional separation of the connecting port 11 and the cable. The protecting cover 12 is configured to cooperate with the connecting port 11 for preventing outside dust particles or substances from entering into the connecting port 11 and preventing an unauthorized connection of the connecting port 11 when the connecting port 11 is not connected to the connector of the cable, i.e., when the connector of the cable is detached from the connecting port 11.

Preferably, in this embodiment, the connecting port device 1 can be an industrial computer or a server host. The connecting port 11 can be a network connecting port. The cable can be a network cable with an RJ45 connector. However, the present invention is not limited to this embodiment.

Figure 6:
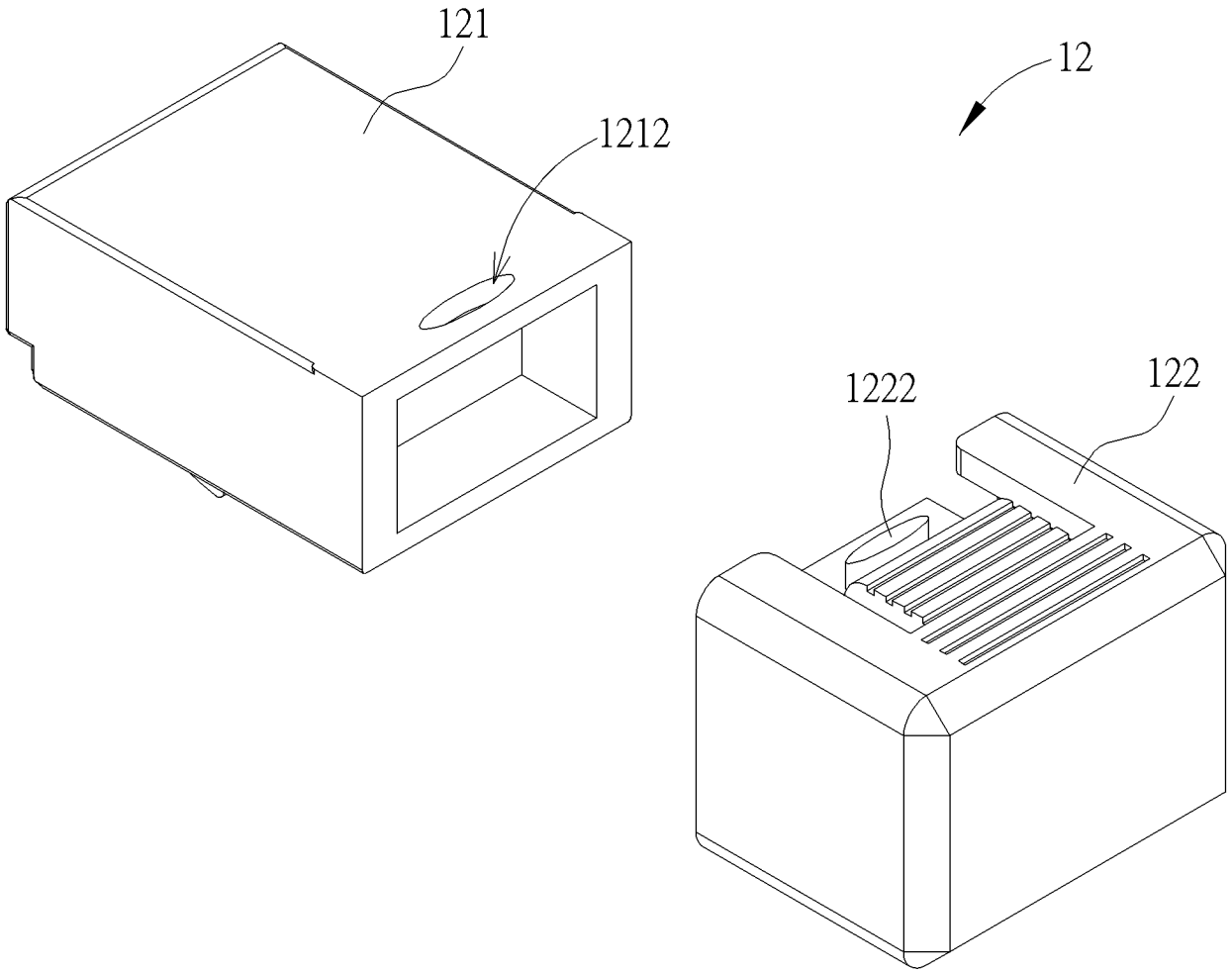
FIG. 6 is an exploded diagram of a protecting cover according to the first embodiment of the present invention.
Figure 7:
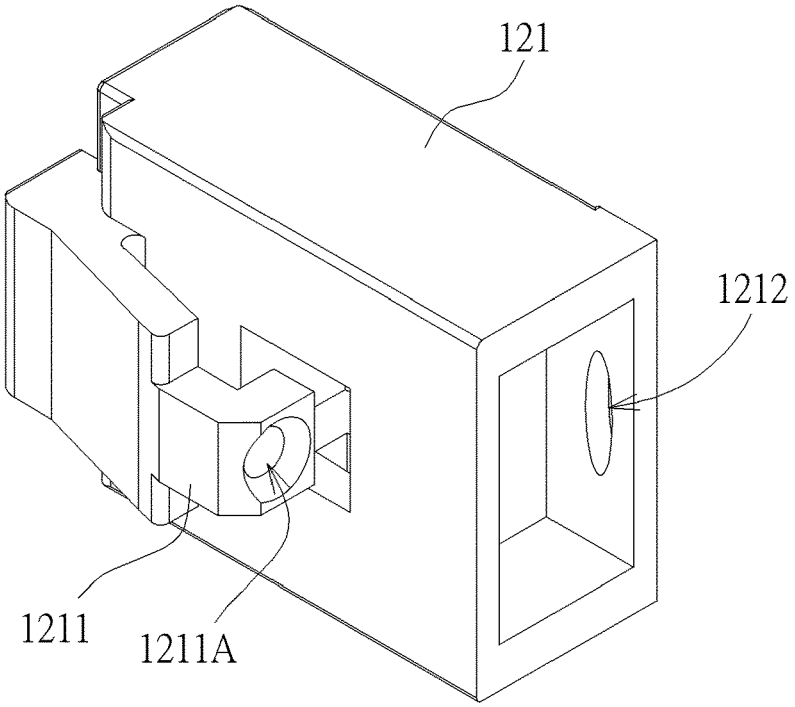
FIG. 7 is a diagram of a latching component of the protecting cover according to the first embodiment of the present invention.
Figure 8:
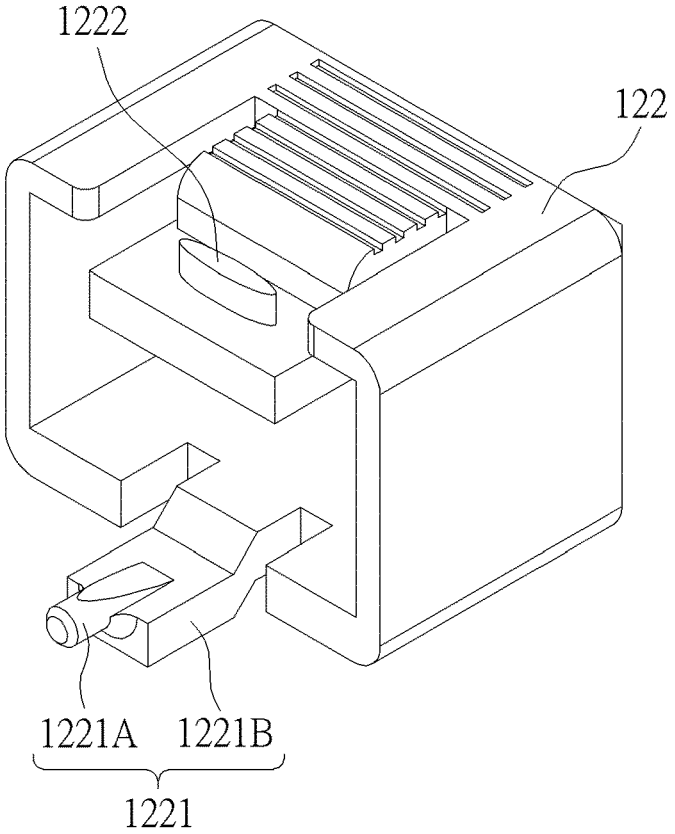
FIG. 8 is a diagram of a releasing component of the protecting cover according to the first embodiment of the present invention.

Please refer to FIG. 1 to FIG. 8. FIG. 6 is an exploded diagram of the protecting cover 12 according to the first embodiment of the present invention. FIG. 7 is a diagram of a latching component 121 of the protecting cover 12 according to the first embodiment of the present invention. FIG. 8 is a diagram of a releasing component 122 of the protecting cover 12 according to the first embodiment of the present invention. As shown in FIG. 1 to FIG. 8, the protecting cover 12 includes the latching component 121 and the releasing component 122. The latching component 121 is configured to be at least partially accommodated inside the connecting port 11 for preventing the outside dust particles or substances from entering into the connecting port 11 and preventing the unauthorized connection of the connecting port 11. The latching component 121 includes an engaging portion 1211 which is configured to engage with the cooperating portion 111 when the latching component 121 is at least partially accommodated inside the connecting port 11. The releasing component 122 is detachably installed on the latching component 121. The releasing component 122 includes a resilient arm 1221 which is configured to abut against the engaging portion 1211 when the releasing component 122 is installed on the latching component 121, so that the engaging portion 1211 can be driven by the resilient arm 1221 to disengage from the cooperating portion 111 during operation of the resilient arm 1221.

As shown in FIG. 2, the latching component 121 covers a front opening 112 of the connecting port 11 when the latching component 121 is at least partially accommodated inside the connecting port 11. This configuration can prevent the outside dust particles or substances from entering into the connecting port 11. Furthermore, as shown in FIG. 3, when the latching component 121 is at least partially accommodated inside the connecting port 11, the engaging portion 1211 does not protrude out of the front opening 112 of the connecting port 11. This configuration can prevent a user from operating the engaging portion 1211 of the latching component 121 directly to disengage the engaging portion 1211 of the latching component 121 from the cooperating portion 111 of the connecting port 11. In other words, the user must use the releasing component 122 to drive the engaging portion 1211 of the latching component 121 to disengage from the cooperating portion 111 of the connecting port 11. Therefore, it can effectively prevent the unauthorized connection of the connecting port 11.

As shown in FIG. 3, FIG. 5, FIG. 7 and FIG. 8, the resilient arm 1221 includes an abutting portion 1221A and an operating portion 1221B connected to the abutting portion 1221A. The abutting portion 1221A abuts against the engaging portion 1211 when the releasing component 122 is installed on the latching component 121. The operating portion 1221B is exposed out of the front opening 112 of the connecting port 11 when the releasing component 122 is installed on the latching component 121 for providing an easy access to the operating portion 1221B for the user. When the operating portion 1221B is operated, the operating portion 1221B drives the abutting portion 1221A to disengage the engaging portion 1211 of the latching component 121 from the cooperating portion 111 of the connecting port 11.

Specifically, in this embodiment, the abutting portion 1221A can be an inserting pin, and an inserting hole 1211A can be formed on the engaging portion 1211. The abutting portion 1221A, i.e., the inserting pin, is inserted into the inserting hole 1211A when the releasing component 122 is installed on the latching component 121. This configuration can not only allow the operating portion 1221B to drive the abutting portion 1221A to disengage the engaging portion 1211 of the latching component 121 from the cooperating portion 111 of the connecting port 11 by the operation of the operating portion 1221B, but also align the releasing component 122 with the latching component 121 by insertion of the abutting portion 1221A into the inserting hole 1211A during installation of the releasing component 122 on the latching component 121. However, the present invention is not limited to this embodiment. For example, in another embodiment, the abutting portion also can be an abutting structure which is configured to abut against a lateral wall of the engaging portion of the latching component for disengaging the engaging portion of the latching component from the cooperating portion of the connecting port when the abutting portion is driven by the operating portion.

Furthermore, preferably, as shown in FIG. 6 to FIG. 8, the releasing component 122 further includes a first connecting portion 1222. The latching component 121 further includes a second connecting portion 1212. When the releasing component 122 is installed on the latching component 121, the first connecting portion 1222 engages with the second connecting portion 1212 for preventing separation of the releasing component 122 and the latching component 121, so as to ensure operational reliability of removing the latching component 121 by the releasing component 122. Preferably, in this embodiment, the first connecting portion 1222 engages with the second connecting portion 1212 along a first direction, and the releasing component 122 is installed on the latching component 121 along a second direction different from the first direction. For example, the first direction can be a vertical direction, and the second direction can be a horizontal direction substantially perpendicular to the vertical direction. The first connecting portion 1222 and the second connecting portion 1212 can be made of resilient material, so that the first connecting portion 1222 and the second connecting portion 1212 can be resiliently engaged with each other for preventing the releasing component 122 from slidably disengaging from the latching component 121. However, the present invention is not limited to this embodiment. For example, in another embodiment, the first connecting portion and the second connecting portion can be omitted.

Figure 9:
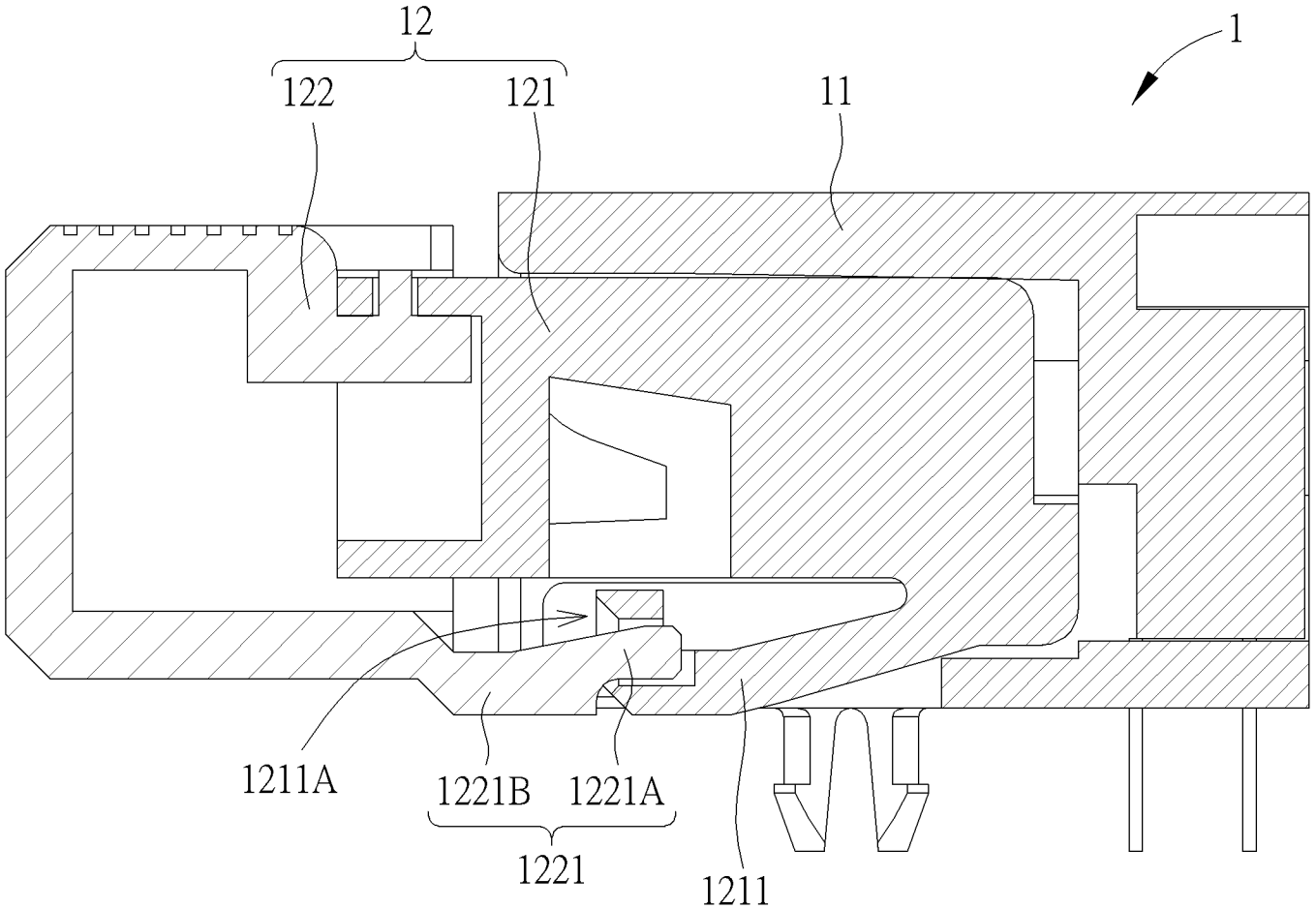
FIG. 9 and FIG. 10 are partial sectional diagrams of the connecting port device in an engaged state at different views according to the first embodiment of the present invention.
Figure 10:
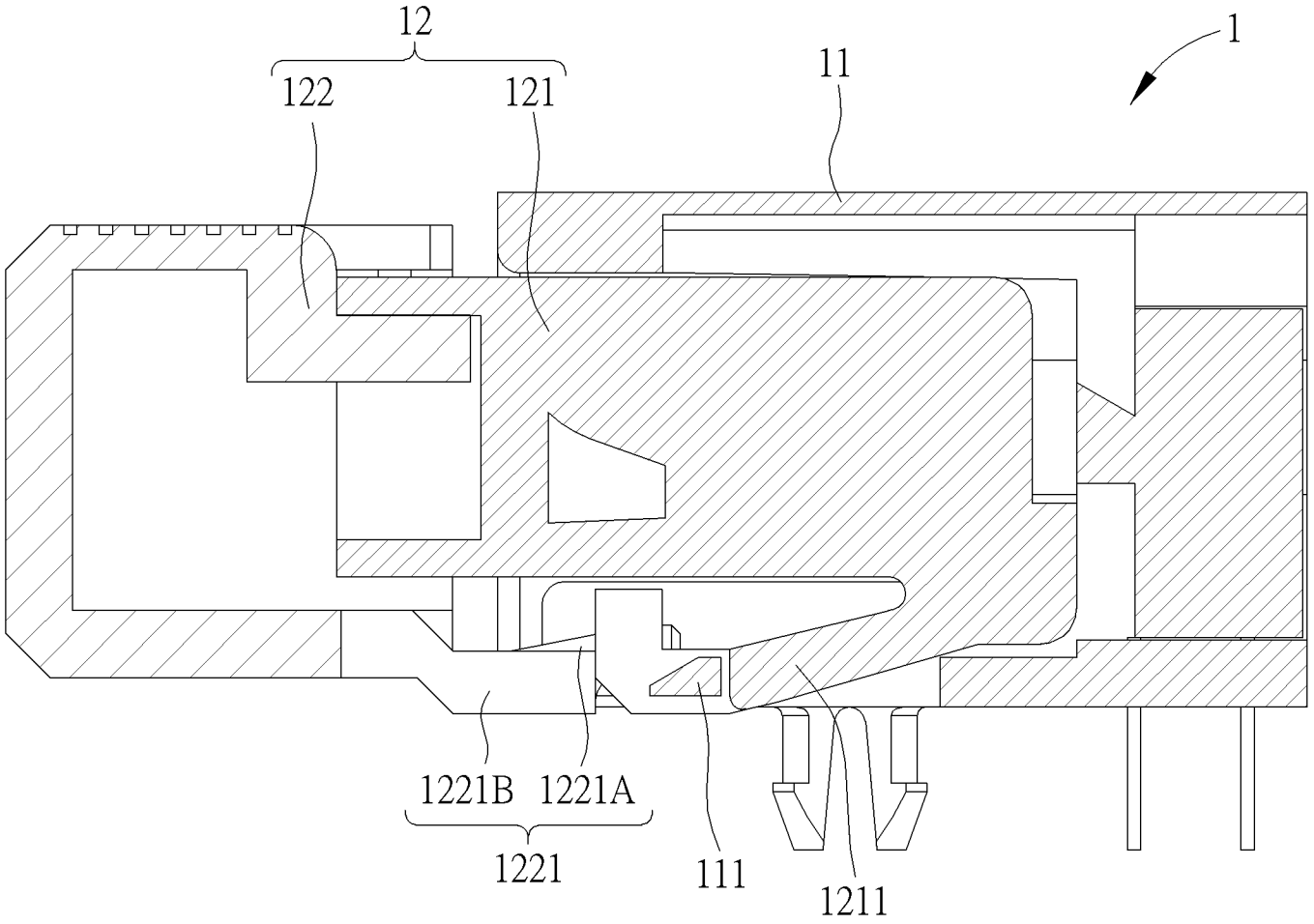
Figure 11:
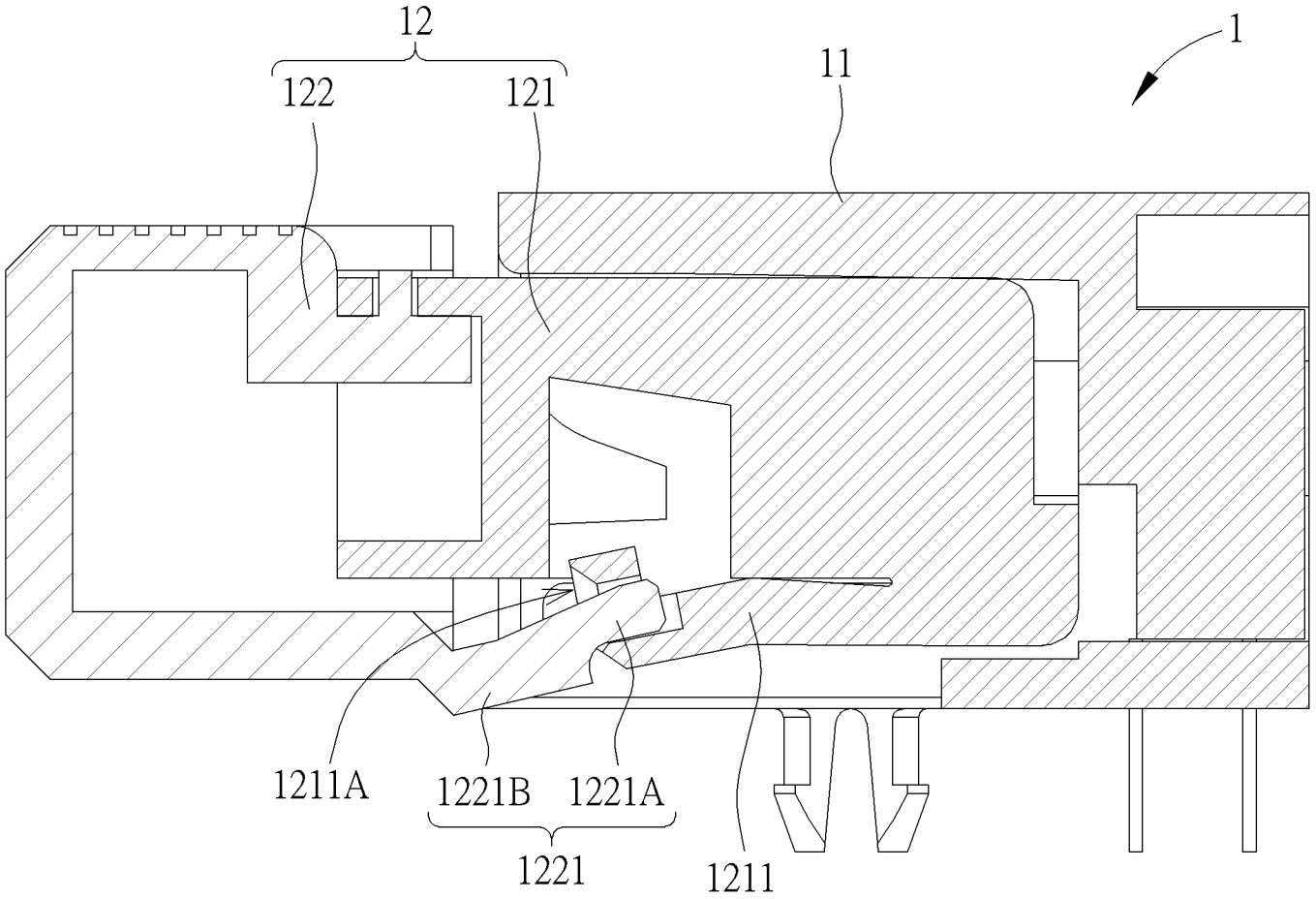
FIG. 11 and FIG. 12 are partial sectional diagrams of the connecting port device in a disengaged state at different views according to the first embodiment of the present invention.
Figure 12:
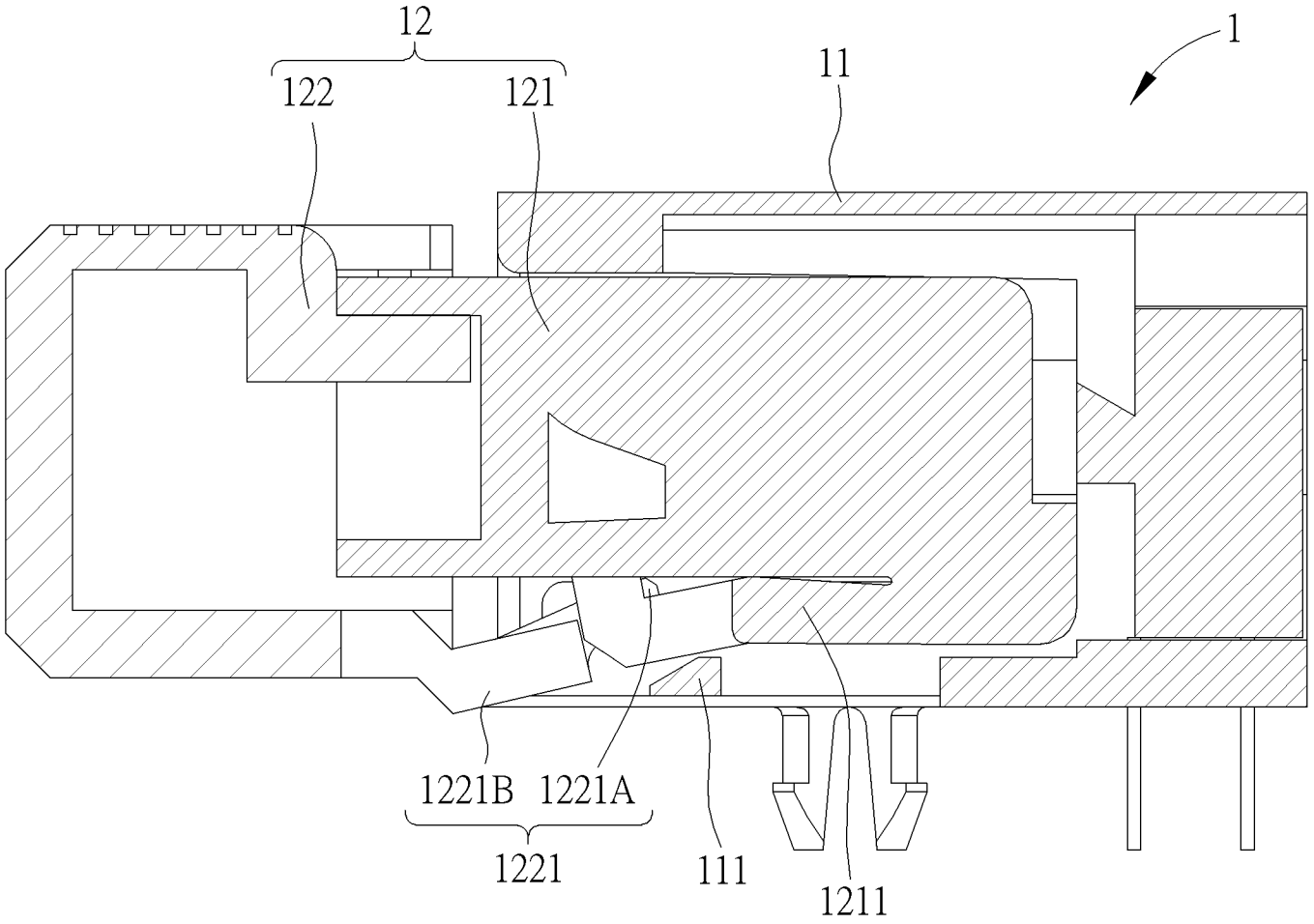

Please refer to FIG. 9 to FIG. 12. FIG. 9 and FIG. 10 are partial sectional diagrams of the connecting port device 1 in an engaged state at different views according to the first embodiment of the present invention. FIG. 11 and FIG. 12 are partial sectional diagrams of the connecting port device 1 in a disengaged state at different views according to the first embodiment of the present invention. When it is desired to use the protecting cover 12 to prevent the outside dust particles or substances from entering into the connecting port 11 and to prevent the unauthorized connection of the connecting port 11, the latching component 121 and the releasing component 122 installed on the latching component 121 can be inserted into the connecting port 11 together, so that the latching component 121 can be located at a position as shown in FIG. 9 and FIG. 10, i.e., the latching component 121 is at least partially accommodated inside the connecting port 11 and the engaging portion 1211 engages with the cooperating portion 111. Afterwards, the releasing component 122 can be detached from the latching component 121 by disengagement of the first connecting portion 1222 and the second connecting portion 1212, e.g., by applying a force which can overcome a resilient engaging force of the first connecting portion 1222 and the second connecting portion 121 to disengage the first connecting portion 1222 from the second connecting portion 1212. At this movement, the latching component 121 at least partially accommodated inside the connecting port 11 can cover the front opening 112 of the connecting port 11. Therefore, it can prevent the outside dust particles or substances from entering into the connecting port 11. Furthermore, the latching component 121 at least partially accommodated inside the connecting port 11 does not protrude from the front opening 112 of the connecting port 11, so that the engaging portion 1211 of the latching component 121 only can be disengaged from the cooperating portion 111 of the connecting port 11 for removal of the latching component 121 by operation of the releasing component 122. Therefore, it can prevent the unauthorized connection of the connecting port 11.

When it is desired to remove the latching component 121 from the connecting port 11, the releasing component 122 can be installed on the latching component 121, so as to drive the abutting portion 1221A to be inserted into the inserting hole 1211A and drive the first connecting portion 1222 to engage with the second connecting portion 1212. After the releasing component 122 is installed on the latching component 121, the operating portion 1221B can be operated, e.g., being pressed, to drive the engaging portion 1211 of the latching component 121 by the abutting portion 1221A to move from a position as shown in FIG. 9 and FIG. 10 to a position as shown in FIG. 11 and FIG. 12 for achieving disengagement of the engaging portion 1211 of the latching component 121 and the cooperating portion 111 of the connecting port 11. Afterwards, the latching component 121 can be removed from the connecting port 11 by pulling the releasing component 122 outwardly. During the aforementioned pulling process, engagement of the first connecting portion 1222 and the second connecting portion 1212 prevents the separation of the releasing component 122 and the latching component 121. Therefore, it ensures the operational reliability of removing the latching component 121 by the releasing component 122.

However, the operation of the protecting cover of the present invention is not limited to this embodiment. For example, when it is desired to use the protecting cover to prevent the outside dust particles or substances from entering into the connecting port and prevent the unauthorized connection of the connecting port, the latching component can be pushed into the connecting portion alone without the releasing component, so as to drive the engaging portion of the latching component to engage with the cooperating portion of the connecting port.

Figure 13:
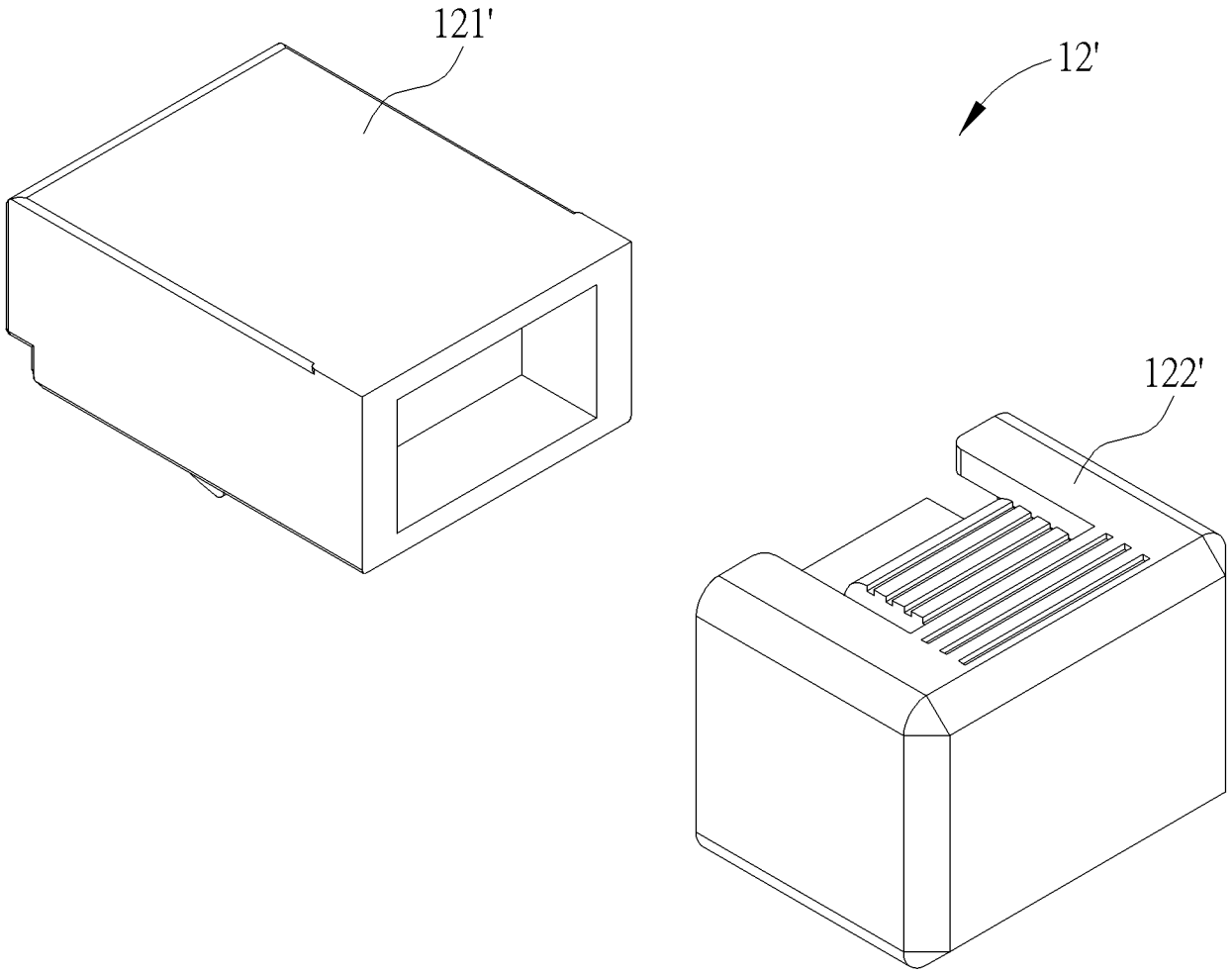
FIG. 13 and FIG. 14 are exploded diagrams of a protecting cover at different views according to a second embodiment of the present invention.
Figure 14:
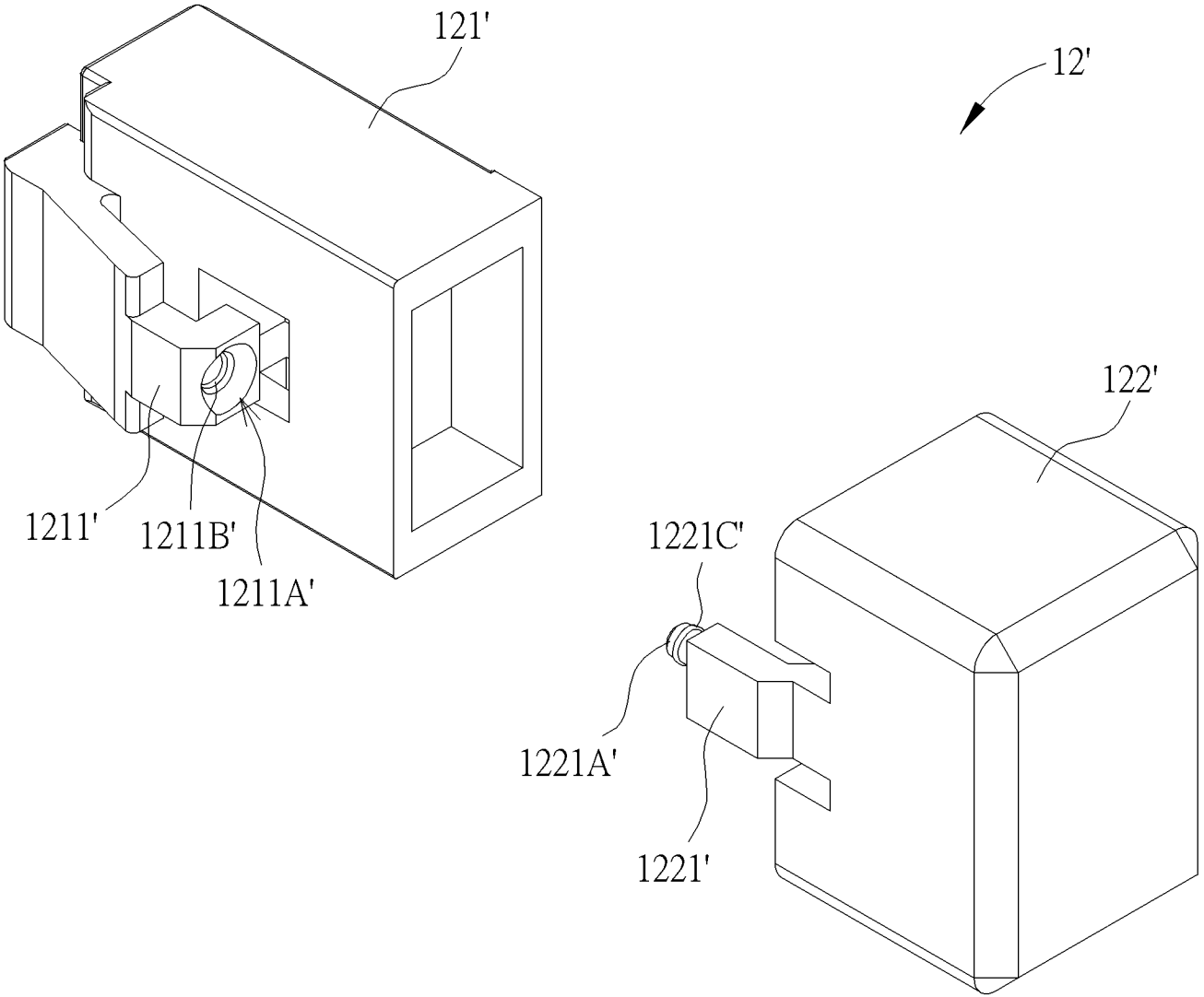

Please refer to FIG. 13 and FIG. 14. FIG. 13 and FIG. 14 are exploded diagrams of a protecting cover 12' at different views according to a second embodiment of the present invention. As shown in FIG. 13 and FIG. 14, different from the first embodiment, a releasing component 122' of this embodiment does not include the first connecting portion 1222 of the first embodiment, and a latching component 121' of this embodiment does not include the second connecting portion 1212 of the first embodiment, i.e., the first connecting portion 1222 and the second connecting portion 1212 of the first embodiment are omitted. Furthermore, a first engaging structure 1221C' and a second engaging structure 1211B' are respectively formed on a resilient arm 1221' and an engaging portion 1211'. Specifically, the first engaging structure 1221C' is formed on an abutting portion 1221A' of the resilient arm 1221'. The second engaging structure 1211B' is formed on an inserting hole 1211A' on the engaging portion 1211'. When the resilient arm 1221' engages with the engaging portion 1211', i.e., when the abutting portion 1221A' of the resilient arm 1221' is inserted into the inserting hole 1211A' on the engaging portion 1211', the first engaging structure 1221C' engages with the second engaging structure 1211B' for preventing separation of the resilient arm 1221' and the engaging portion 1211', so as to prevent separation of the releasing component 122' and the latching component 121'. However, the present invention is not limited to this embodiment. For example, in another embodiment, when the abutting portion is an abutting structure for abutting against the lateral wall of the engaging portion, the first engaging structure and the second engaging structure can be an engaging hook on the abutting portion and an engaging recess on the lateral wall of the engaging portion. Alternatively, in another embodiment, the releasing component can include both of the first connecting portion and the first engaging structure, and the latching component can include both of the second connecting portion and the second engaging structure which are configured to engage with the first connecting portion and the first engaging structure respectively.

In contrast to the prior art, in the present invention, the latching component at partially accommodated inside the connecting port can effectively prevent the outside dust particles or substances from entering into the connecting port. Furthermore, the engaging portion of the latching component only can be driven by the resilient arm to disengage from the cooperating portion of the connecting portion during operation of the resilient arm. Therefore, an unauthorized user cannot remove the latching component from the connecting port without the releasing component when the latching component is partially accommodated inside the connecting port and the releasing component is detached from the latching component. Therefore, the present invention can not only prevent the outside dust particles or substances from entering into the connecting port but also prevent the unauthorized connection of the connecting port.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A protecting cover adapted for a connecting port, the protecting cover comprising:

a latching component at least partially accommodated inside the connecting port, the latching component comprising an engaging portion, the engaging portion engaging with a cooperating portion of the connecting port when the latching component is at least partially accommodated inside the connecting port; and a releasing component detachably installed on the latching component, the releasing component comprising a resilient arm, the resilient arm abutting against the engaging portion when the releasing component is installed on the latching component, the resilient arm not driving the engaging portion to disengage from the cooperating portion during a process of installation of the releasing component on the latching component, and the resilient arm driving the engaging portion to disengage from the cooperating portion when the resilient arm is operated.

2. The protecting cover of claim 1, wherein the engaging portion does not protrude out of a front opening of the connecting port when the latching component is at least partially accommodated inside the connecting port.

3. The protecting cover of claim 2, wherein the resilient arm comprises an abutting portion and an operating portion connected to the abutting portion, the abutting portion abuts against the engaging portion when the releasing component is installed on the latching component, the operating portion is exposed out of the front opening of the connecting port when the releasing component is installed on the latching component, and the operating portion drives the abutting portion to disengage the engaging portion from the cooperating portion when the operating portion is operated.

4. The protecting cover of claim 3, wherein the abutting portion is an inserting pin, an inserting hole is formed on the engaging portion, and the inserting pin is inserted into the inserting hole when the releasing component is installed on the latching component.

5. The protecting cover of claim 3, wherein the releasing component further comprises a first connecting portion, the latching component further comprises a second connecting portion, and the first connecting portion engages with the second connecting portion for preventing separation of the releasing component and the latching component when the releasing component is installed on the latching component.

6. The protecting cover of claim 3, wherein a first engaging structure is formed on the resilient arm, a second engaging structure is formed on the engaging portion, and the first engaging structure engages with the second engaging structure for preventing separation of the resilient arm and the engaging portion when the resilient arm abuts against the engaging portion.

7. The protecting cover of claim 2, wherein the releasing component further comprises a first connecting portion, the latching component further comprises a second connecting portion, and the first connecting portion engages with the second connecting portion for preventing separation of the releasing component and the latching component when the releasing component is installed on the latching component.

8. The protecting cover of claim 2, wherein a first engaging structure is formed on the resilient arm, a second engaging structure is formed on the engaging portion, and the first engaging structure engages with the second engaging structure for preventing separation of the resilient arm and the engaging portion when the resilient arm abuts against the engaging portion.

9. The protecting cover of claim 1, wherein the releasing component further comprises a first connecting portion, the latching component further comprises a second connecting portion, and the first connecting portion engages with the second connecting portion for preventing separation of the releasing component and the latching component when the releasing component is installed on the latching component.

10. The protecting cover of claim 1, wherein a first engaging structure is formed on the resilient arm, a second engaging structure is formed on the engaging portion, and the first engaging structure engages with the second engaging structure for preventing separation of the resilient arm and the engaging portion when the resilient arm abuts against the engaging portion.

11. A connecting port device comprising:

a connecting port comprising a cooperating portion; and a protecting cover comprising:

a latching component at least partially accommodated inside the connecting port, the latching component comprising an engaging portion, the engaging portion engaging with the cooperating portion when the latching component is at least partially accommodated inside the connecting port; and a releasing component detachably installed on the latching component, the releasing component comprising a resilient arm, the resilient arm abutting against the engaging portion when the releasing component is installed on the latching component, the resilient arm not driving the engaging portion to disengage from the cooperating portion during a process of installation of the releasing component on the latching component, and the resilient arm driving the engaging portion to disengage from the cooperating portion when the resilient arm is operated.

12. The connecting port device of claim 11, wherein the engaging portion does not protrude out of a front opening of the connecting port when the latching component is at least partially accommodated inside the connecting port.

13. The connecting port device of claim 12, wherein the resilient arm comprises an abutting portion and an operating portion connected to the abutting portion, the abutting portion abuts against the engaging portion when the releasing component is installed on the latching component, the operating portion is exposed out of the front opening of the connecting port when the releasing component is installed on the latching component, and the operating portion drives the abutting portion to disengage the engaging portion from the cooperating portion when the operating portion is operated.

14. The connecting port device of claim 13, wherein the abutting portion is an inserting pin, an inserting hole is formed on the engaging portion, and the inserting pin is inserted into the inserting hole when the releasing component is installed on the latching component.

15. The connecting port device of claim 13, wherein the releasing component further comprises a first connecting portion, the latching component further comprises a second connecting portion, and the first connecting portion engages with the second connecting portion for preventing separation of the releasing component and the latching component when the releasing component is installed on the latching component.

16. The connecting port device of claim 13, wherein a first engaging structure is formed on the resilient arm, a second engaging structure is formed on the engaging portion, and the first engaging structure engages with the second engaging structure for preventing separation of the resilient arm and the engaging portion when the resilient arm abuts against the engaging portion.

17. The connecting port device of claim 12, wherein the releasing component further comprises a first connecting portion, the latching component further comprises a second connecting portion, and the first connecting portion engages with the second connecting portion for preventing separation of the releasing component and the latching component when the releasing component is installed on the latching component.

18. The connecting port device of claim 12, wherein a first engaging structure is formed on the resilient arm, a second engaging structure is formed on the engaging portion, and the first engaging structure engages with the second engaging structure for preventing separation of the resilient arm and the engaging portion when the resilient arm abuts against the engaging portion.

19. The connecting port device of claim 11, wherein the releasing component further comprises a first connecting portion, the latching component further comprises a second connecting portion, and the first connecting portion engages with the second connecting portion for preventing separation of the releasing component and the latching component when the releasing component is installed on the latching component.

20. The connecting port device of claim 11, wherein a first engaging structure is formed on the resilient arm, a second engaging structure is formed on the engaging portion, and the first engaging structure engages with the second engaging structure for preventing separation of the resilient arm and the engaging portion when the resilient arm abuts against the engaging portion.

* * * * *